US011499716B2

(12) United States Patent
Lyons et al.

(10) Patent No.: US 11,499,716 B2
(45) Date of Patent: Nov. 15, 2022

(54) FURNACE SUBASSEMBLY, FURNACE BLOWER AND ASSOCIATED METHOD

(71) Applicant: Regal Beloit America, Inc., Beloit, WI (US)

(72) Inventors: Leslie A Lyons, Cassville, MO (US); Jeffrey C Hutson, Cassville, MO (US); Byron D Glanton, Bentonville, AR (US); John Sheldon Wagley, Winona Lake, IN (US)

(73) Assignee: Regal Beloit America, Inc., Beloit, WI (US)

( * ) Notice: Subject to any disclaimer, the term of this patent is extended or adjusted under 35 U.S.C. 154(b) by 781 days.

(21) Appl. No.: 15/197,860

(22) Filed: Jun. 30, 2016

(65) Prior Publication Data

US 2018/0003382 A1 Jan. 4, 2018

(51) Int. Cl.

| | |
|---|---|
| ***F23L 17/00*** | (2006.01) |
| ***F04D 17/16*** | (2006.01) |
| ***F04D 29/60*** | (2006.01) |
| ***F04D 29/42*** | (2006.01) |

(52) U.S. Cl.

CPC ..... *F23L 17/005* (2013.01); *F04D 17/16* (2013.01); *F04D 29/4226* (2013.01); *F04D 29/601* (2013.01); *F05D 2230/64* (2013.01); *F05D 2250/52* (2013.01)

(58) Field of Classification Search

CPC ..... F16L 21/00; F16L 25/10; F23L 17/005; F04D 29/4226; F04D 29/601; F04D 29/603; F04D 17/16; F05D 2250/52; F05D 2230/64

See application file for complete search history.

(56) References Cited

U.S. PATENT DOCUMENTS

| | | | | |
|---|---|---|---|---|
| 354,766 | A * | 12/1886 | Brinkerhoff | F23L 17/005 126/80 |
| 4,550,937 | A * | 11/1985 | Duret | E21B 17/042 285/114 |
| 5,058,492 | A | 10/1991 | Norton | |
| 5,158,446 | A * | 10/1992 | Hall | F23L 17/005 122/14.1 |

(Continued)

FOREIGN PATENT DOCUMENTS

| | | | | |
|---|---|---|---|---|
| CN | 201250802 | Y † | 6/2009 | |
| EP | 1450962 | B1 | 4/2009 | |
| JP | 3415905 | B2 * | 6/2003 | B29C 65/48 |

*Primary Examiner* — Courtney D Heinle
*Assistant Examiner* — Danielle M. Christensen
(74) *Attorney, Agent, or Firm* — Armstrong Teasdale LLP

(57) ABSTRACT

A furnace blower assembly includes a blower housing a blower and a motor. The blower is positioned within the housing and is adapted to rotate relative to the housing. The motor is coupled to the blower. The housing defines an outlet having an external periphery and an internal periphery. The external periphery or the internal periphery of the outlet is adapted to be fitted to a portion of the external periphery or the internal periphery of the duct. The outlet defines a longitudinal axis. The outlet has a peripheral edge and a protrusion extending outwardly from the external periphery or the internal periphery of the outlet. The protrusion is spaced from the peripheral edge of the outlet and is adapted to abut the peripheral edge of the duct.

18 Claims, 11 Drawing Sheets

(56) References Cited

U.S. PATENT DOCUMENTS

| | | | | |
|---|---|---|---|---|
| 5,467,250 | A | 11/1995 | Howard et al. | |
| 5,547,232 | A † | 8/1996 | Waterman | |
| 6,039,041 | A | 3/2000 | Barth | |
| 6,193,285 | B1 * | 2/2001 | Proctor | F16L 21/035 285/110 |
| 6,835,129 | B1 | 12/2004 | McClendon | |
| 7,523,964 | B2 * | 4/2009 | Sandman | F16L 17/025 277/616 |
| 8,419,515 | B1 | 4/2013 | Dillon | |
| 8,475,146 | B2 * | 7/2013 | Liu | F04D 29/4226 415/206 |
| 8,579,334 | B2 * | 11/2013 | Schnallinger | F16L 37/127 285/364 |
| 2005/0218655 | A1 | 10/2005 | Ruid et al. | |
| 2006/0057954 | A1 | 3/2006 | Hrebeniuk | |
| 2006/0214423 | A1 * | 9/2006 | Sandman | F16L 17/025 285/370 |
| 2007/0213001 | A1 | 9/2007 | Vander Berg et al. | |
| 2008/0164694 | A1 * | 7/2008 | Zdroik | F02M 69/462 285/331 |
| 2014/0048167 | A1 | 2/2014 | Gudenburr et al. | |

* cited by examiner
† cited by third party

FURNACE SUBASSEMBLY, FURNACE BLOWER AND ASSOCIATED METHOD

BACKGROUND OF THE INVENTION

The field of the invention relates generally to furnace blower assemblies.

A furnace blower assembly typically includes a blower, a motor to propel the blower, and a housing for supporting the motor and for direction the flow of air from the blower. The housing includes an outlet to which a furnace duct is connected to transmit the airflow out of the furnace.

Attempts to connect and seal a furnace blower outlet to a furnace duct may not be effective and may be expensive. Inexpensive and reliable connecting and sealing of a furnace blower outlet to a furnace duct is desirable in the design and manufacture of blower assemblies for furnaces.

The present invention is directed to alleviate at least some of these problems with the prior art.

BRIEF DESCRIPTION OF THE INVENTION

According to an embodiment of the invention, a furnace blower assembly for cooperation with a duct having an interior periphery and an exterior periphery may be provided. The duct defines a peripheral edge. The furnace blower assembly includes a blower housing, a blower and a motor. The blower is positioned at least partially within the housing. The blower is adapted to rotate relative to the housing about a blower axis.

The motor is operatively coupled to the blower. The housing defines an outlet of the blower. The outlet has an external periphery of the housing and an internal periphery of the housing. A portion of external periphery or the internal periphery of the outlet is adapted to be at least fitted to a portion of the other of the external periphery and the internal periphery of the duct. The outlet defines a longitudinal axis of the outlet. The outlet defines a peripheral edge of the outlet. The outlet defines a protrusion extending outward from the external periphery or the internal periphery of the outlet. The protrusion is spaced from the peripheral edge of the outlet. The protrusion is adapted to abut the peripheral edge of the duct.

According to an aspect of the present invention, the furnace blower assembly may be provided wherein a portion of the internal periphery of the outlet may be fitted to a portion of the external periphery of the duct and wherein the protrusion of the outlet of the housing extends from the internal periphery of the outlet.

According to another aspect of the present invention, the furnace blower assembly may be provided wherein a portion of the external periphery of the outlet may be fitted to a portion of the internal periphery of the duct, and wherein the protrusion of the outlet of the housing extends from the external periphery of the outlet.

According to another aspect of the present invention, the furnace blower assembly may be provided wherein the protrusion of the outlet of the housing includes an external bead formed from the housing.

According to another aspect of the present invention, the furnace blower assembly may be provided wherein the protrusion of the outlet of the housing extends peripherally around the outlet in a direction generally perpendicular to the longitudinal axis of the outlet.

According to another aspect of the present invention, the furnace blower assembly may be provided wherein the protrusion of the outlet of the housing extends peripherally around substantially all of the outlet.

According to another aspect of the present invention, the furnace blower assembly may be provided wherein the protrusion of the outlet of the housing extends peripherally around the outlet in a generally planar orientation and in a direction generally skewed to the longitudinal axis of the outlet.

According to another aspect of the present invention, the furnace blower assembly may be provided wherein the protrusion of the outlet of the housing is adapted to provide a substantially airtight seal between the duct and the housing.

According to another aspect of the present invention, the furnace blower assembly may be provided wherein the protrusion of the outlet of the housing defines a dimension normal to the external periphery of the outlet that is greater than the thickness of the wall of the duct.

According to another aspect of the present invention, the furnace blower assembly may be provided wherein the protrusion of the outlet of the housing has a generally uniform cross section.

According to another aspect of the present invention, the furnace blower assembly may be provided wherein the protrusion of the outlet of the housing has a generally inverted U-shaped cross section.

According to another aspect of the present invention, the furnace blower assembly may be provided wherein the cross section of the protrusion has an arcuate periphery.

According to another aspect of the present invention, the furnace blower assembly may be provided wherein the cross section of the protrusion includes two generally rectangular portions extending generally normal to the longitudinal axis of the outlet.

According to another embodiment of the invention, a furnace sub assembly for use in a furnace is provided. The furnace sub assembly includes a duct and a furnace blower assembly. The duct has an interior periphery and an exterior periphery of the duct and defines a peripheral edge of the duct.

The furnace blower assembly is adapted for use in the furnace and is operably connected to the housing. The furnace blower assembly includes a blower housing, a blower and a motor.

The blower is positioned at least partially within the blower housing. The blower is adapted to rotate relative to the housing about a blower axis.

The motor is operatively coupled to the blower. The housing defines an outlet of the housing. The outlet has an external periphery of the outlet and an internal periphery of the outlet. A portion of the external periphery or the internal periphery of the outlet is adapted to be fitted to at least a portion of one of the external periphery and the internal periphery of the duct. The outlet defines a longitudinal axis of the outlet. The outlet defines a peripheral edge of the outlet. The outlet or the duct defines a protrusion extending outwardly from the external periphery or the internal periphery of the respective one of the outlet and the duct. The protrusion is spaced from the peripheral edge of the respective one of the outlet and the duct. The protrusion is adapted to abut the edge of the respective one of the outlet and the duct.

According to another aspect of the present invention, the furnace sub assembly may be provided wherein a portion of the external periphery of the outlet is adapted to be fitted to a portion of the internal periphery of the duct, wherein the protrusion extends outwardly from the external periphery of the outlet, and wherein the protrusion is adapted to abut the edge of the duct.

According to another aspect of the present invention, the furnace sub assembly may be provided wherein a portion of the internal periphery of the outlet is adapted to be fitted to a portion of the external periphery of the duct, wherein the protrusion extends outwardly from the internal periphery of the outlet, and wherein the protrusion is adapted to abut the edge of the duct.

According to another aspect of the present invention, the furnace sub assembly may be provided wherein a portion of the internal periphery of the duct is adapted to be fitted to a portion of the external periphery of the outlet, wherein the protrusion extends outwardly from the internal periphery of the duct, and wherein the protrusion is adapted to abut the edge of the outlet.

According to another aspect of the present invention, the furnace sub assembly may be provided wherein a portion of the external periphery of the duct is adapted to be fitted to a portion of the internal periphery of the outlet, wherein the protrusion extends outwardly from the external periphery of the duct, and wherein the protrusion is adapted to abut the edge of the outlet.

According to another aspect of the present invention, the furnace sub assembly may be provided wherein the protrusion includes an external bead formed in one of the housing and the duct.

According to another embodiment of the invention, a method for sealing a blower housing to a duct in a furnace is provided. The method includes the steps of providing a blower housing having an outlet of the blower housing, the outlet having an external periphery of the outlet and an internal periphery of the outlet. The method also includes the step of providing a duct having an external periphery thereof and an internal periphery thereof and the step of sizing the duct and the outlet such that a portion of one of the external periphery and the internal periphery of one of the outlet and the duct is adapted to be at least fitted to a portion of one of the external periphery and the internal periphery of other of the one of the outlet and the duct. The method also includes the step of forming a protrusion extending outwardly from one of the external periphery and the internal of one of the outlet and the duct and spaced from a peripheral edge of one of the duct and the outlet and the step of abutting one of the outlet and the duct to the protrusion to provide an at least partial seal between the duct and the housing.

DETAILED DESCRIPTION OF THE INVENTION

The method, systems and apparatus described herein provide for a furnace blower assembly and furnace sub assembly with improved performance and reduced cost.

The furnace blower assembly typically includes an outlet to which a furnace duct is connected to transmit the air flow out of the furnace.

Attempts to connect and seal a furnace blower outlet to a furnace duct may not be effective and may be expensive. Inexpensive and reliable connecting and sealing of a furnace blower outlet to a furnace duct is desirable in the design and manufacture of blower assemblies for furnaces. The method, systems and apparatus described herein facilitate connecting and sealing of a furnace blower outlet to a furnace duct. Designs and methods are provided herein to facilitate inexpensive and reliable connecting and sealing of a furnace blower outlet to a furnace duct.

Technical effects of the methods, systems, and apparatus described herein include at least one of reduced cost, improved serviceability, improved performance and quality and reduced labor costs.

Figure 1:
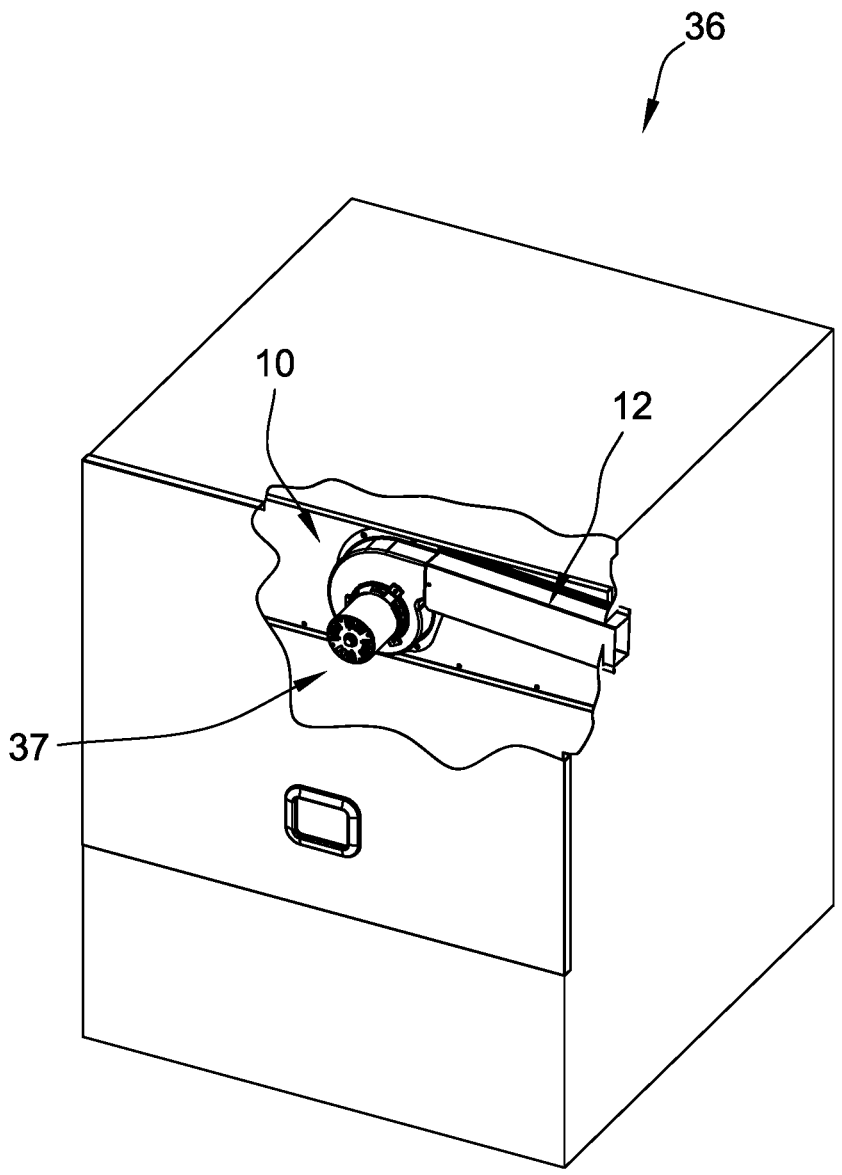
FIG. 1 is a perspective view of a furnace according to an embodiment of the present invention.
Figure 2:
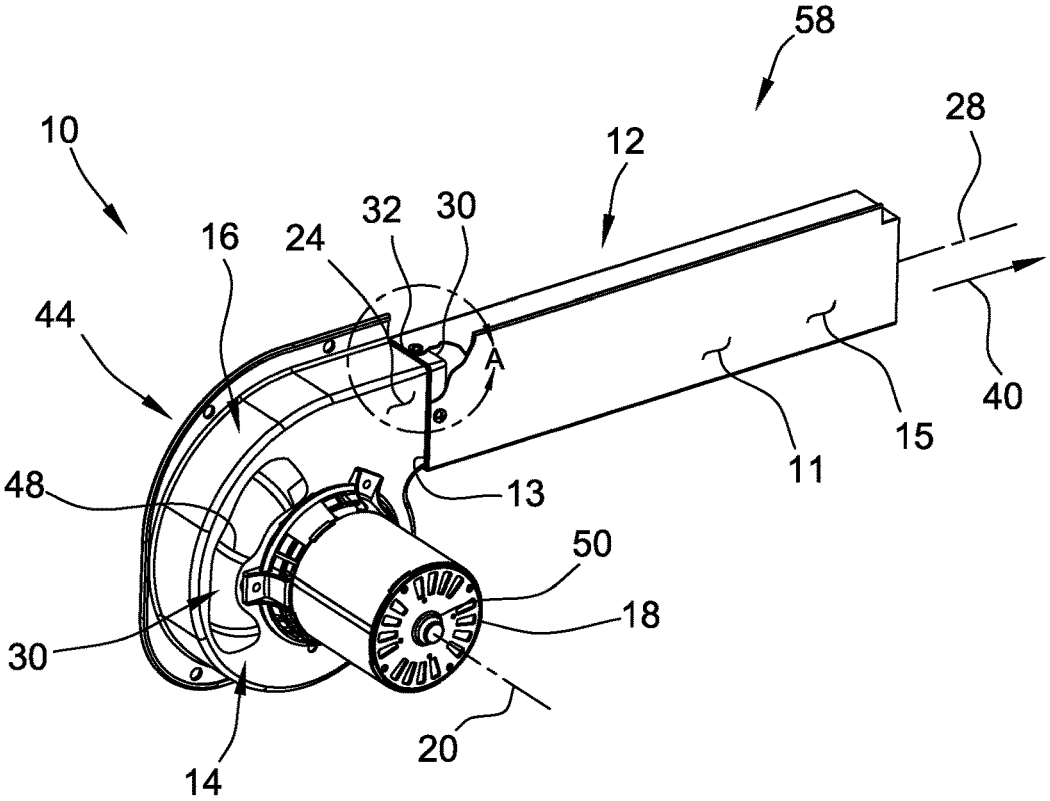
FIG. 2 is a perspective view of a furnace blower assembly according to an embodiment of the present invention.

According to an embodiment of the invention, and referring to FIGS. 1 and 2, a furnace combustion blower assembly 10 for cooperation with a duct 12 is provided. The duct 12 defines a peripheral edge 13 and has an interior periphery 11 and an exterior periphery 15. The furnace combustion blower assembly 10 includes a blower 14, a blower housing 16 and a motor 18. The blower 14 is positioned at least partially within the housing 16. The blower 14 is adapted to rotate relative to the housing 16 about a blower axis 20.

The motor 18 is operatively coupled to the blower 14. The blower housing 16 defines a blower housing outlet 22 of the blower housing 16. The blower housing outlet 22 has an external periphery 24 of the blower housing outlet 22 of the housing 16 and an internal periphery 26 of the blower housing outlet 22 of the housing 16. A portion of external periphery 24 or the internal periphery 26 of the outlet 22 is adapted to be at least fitted to a portion of the other of the external periphery 15 and the internal periphery 11 of the duct 12. The outlet 22 defines a longitudinal axis 28 of the outlet 22. The outlet 22 defines a peripheral edge 30 of the outlet 22. The outlet 22 defines a protrusion 32 extending outward from the external periphery 24 or from the internal periphery 26 of the outlet 22. The protrusion 32 is spaced from the peripheral edge 30 of the outlet 22. The protrusion 32 is adapted to abut the peripheral edge 13 of the duct 12.

Referring now to FIG. 1, the furnace combustion blower assembly 10, also known as a combustion blower or an inducer, is shown in use on a high efficiency furnace 36, for example, a natural gas or bottle gas furnace. The high efficiency furnace 36 is of the type that has a near "condensing flame" or provides stoichiometric ratio or a precise measure of air to fuel for the combustion process. Further, the high efficiency furnace 36 allows the flame to cool in the furnace, letting less heat up the chimney. This improved efficiency results in an inadequate "draw" of air into the combustion chamber by the chimney, thus the inducer 10 which supplies a precise measure of air to combustion is needed.

As shown in FIG. 1, the furnace blower assembly 10 is shown positioned in collector box 37 of furnace 36. The furnace blower assembly 10 pulls combustion products from the collector box 37 and blows through the duct 12 and out the side of the furnace 36.

Referring again to FIG. 2, the blower housing 16 may have any shape that provides a housing to the blower 14. To provide for a rotating blower 14, the housing 16 may include an inner portion 38. The inner portion 38 may be a cylindrical portion that at least partially surrounds the blower 14 and at least partially contains an airflow 40 from the blower 14. The blower housing 16 may be made of any suitable material, for example a polymer or a metal. The blower housing 16 may be made by any suitable process, for example by molding or by stamping.

The inner portion 38 may have any cross sectional shape and may, for simplicity, have a rectangular cross section as shown in FIG. 2. Alternate shapes of the cross section, including arcuate shapes, are possible. The inner portion 38 may surround the periphery of the blower 14, or may, as shown, have an open side or face 42 which may include an air inlet 44 and which may be at least partially covered by wall 46 of furnace 36.

The blower housing 16 may, as shown in FIG. 2, include outlet portion or outlet 22. The outlet 22 extends preferably, as shown, tangentially from the inner portion 38 in the direction of airflow 40.

The outlet portion or outlet 22 may have any cross sectional shape and may for simplicity have a rectangular cross section as shown in FIG. 2. Alternate shapes of the cross section, including arcuate shapes, are possible.

The blower 14 may have any size and shape and may fit, at least partially, within the housing 16. The blower may include members 48 for propelling air. The blower may be, for example in the form of a fan or a blower wheel. If in the form of a fan, the blower may include a member or members in the form of a blade or blades. If in the form of a blower wheel, the blower wheel may include a member or members in the form of a fin or a paddle or fins or paddles. The members may be adapted to assist in the airflow 40. The blower 14 may be made of any suitable material, for example a polymer or a metal. The blower 14 may be made by any suitable process, for example by molding or by stamping. As shown in FIG. 2, the blower 14 is adapted to rotate relative to the housing 16 about the blower axis 20.

The motor 18 may be any motor capable of powering the blower 14. The motor 18 may be an axial flux motor or a radial flux motor. The motor 18 may be a single speed motor, a multiple speed motor or a variable speed motor. The motor 18 may be, for example, an induction motor, a switched reluctance motor or a permanent magnet motor. The motor may be an electrically commutated motor. The motor 18 may include a shaft 50 to which the blower 14 may be attached.

Figure 5:
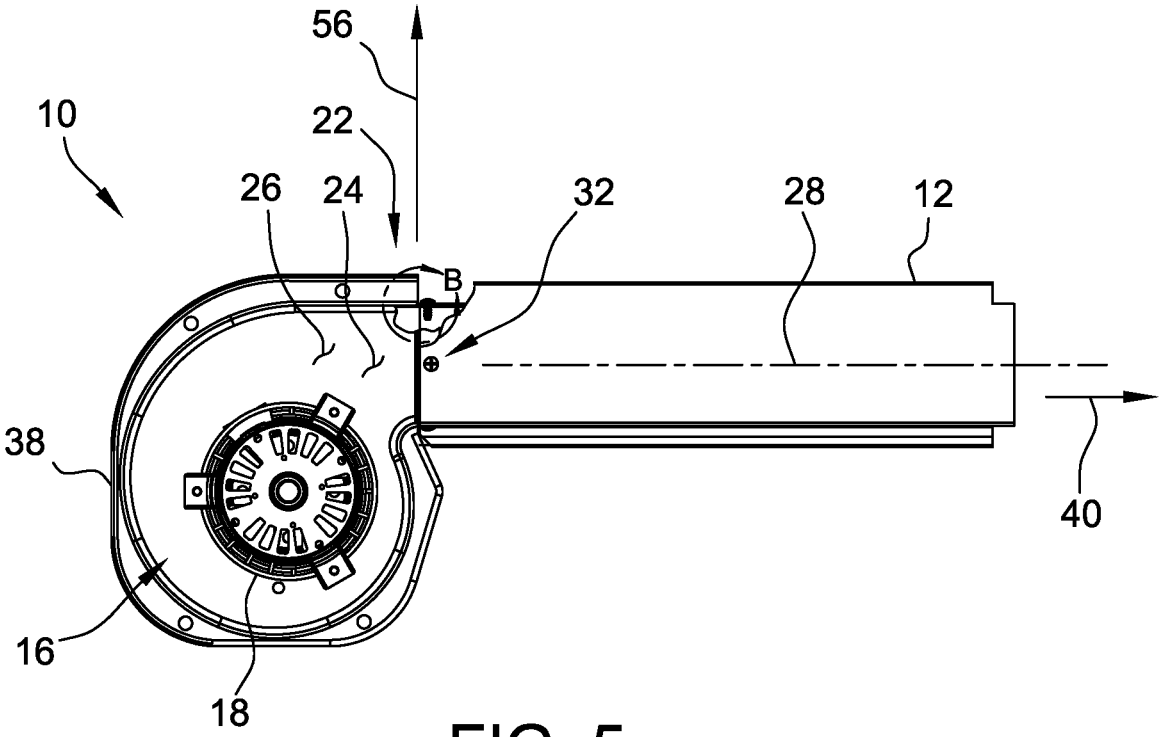
FIG. 5 is a plan view of the furnace blower assembly of FIG. 2.

Referring now to FIGS. 2 and 5, the blower housing outlet 22 has external periphery 24 of the blower housing outlet 22 and internal periphery 26 of the blower housing outlet 22.

Figure 2A:
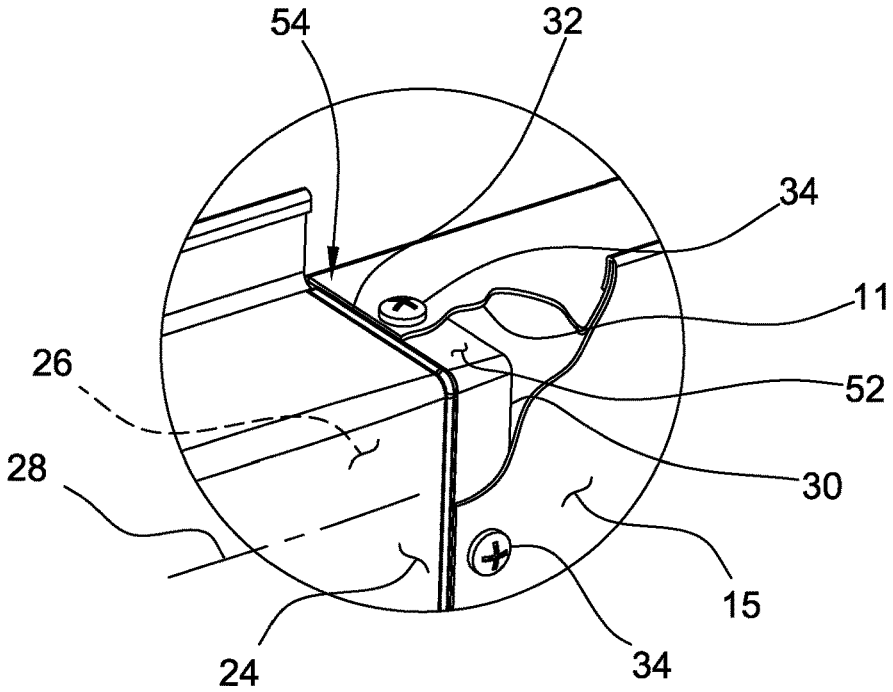
FIG. 2A is a perspective view of an enlarged view of a portion of the furnace blower assembly of FIG. 2, showing the protrusion in greater detail and positioned on the exterior of the outlet.
Figure 5A:
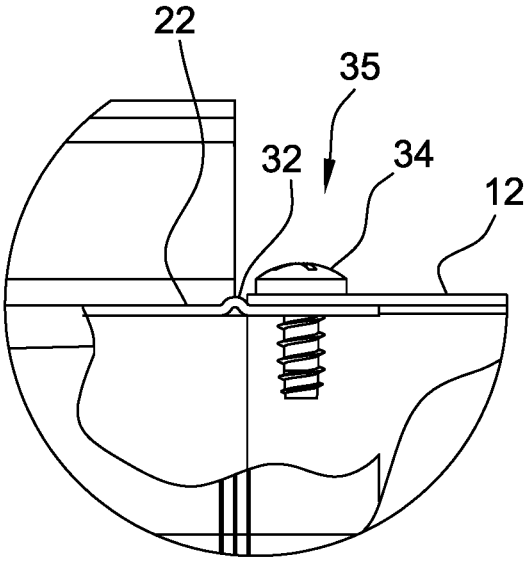
FIG. 5A is enlarged view of a portion of the furnace blower assembly of FIG. 2, showing the protrusion in greater detail and positioned on the exterior of the outlet.

It should be appreciated that for the blower housing outlet 22 and the duct 12 to be connected to each other and provide containment of the air flow 40, a portion 52 of the external periphery 24 the outlet 22 may, as shown in FIGS. 2A and 5A, be fitted within a portion 54 of the internal periphery 11 of the duct 12.

Figure 2B:
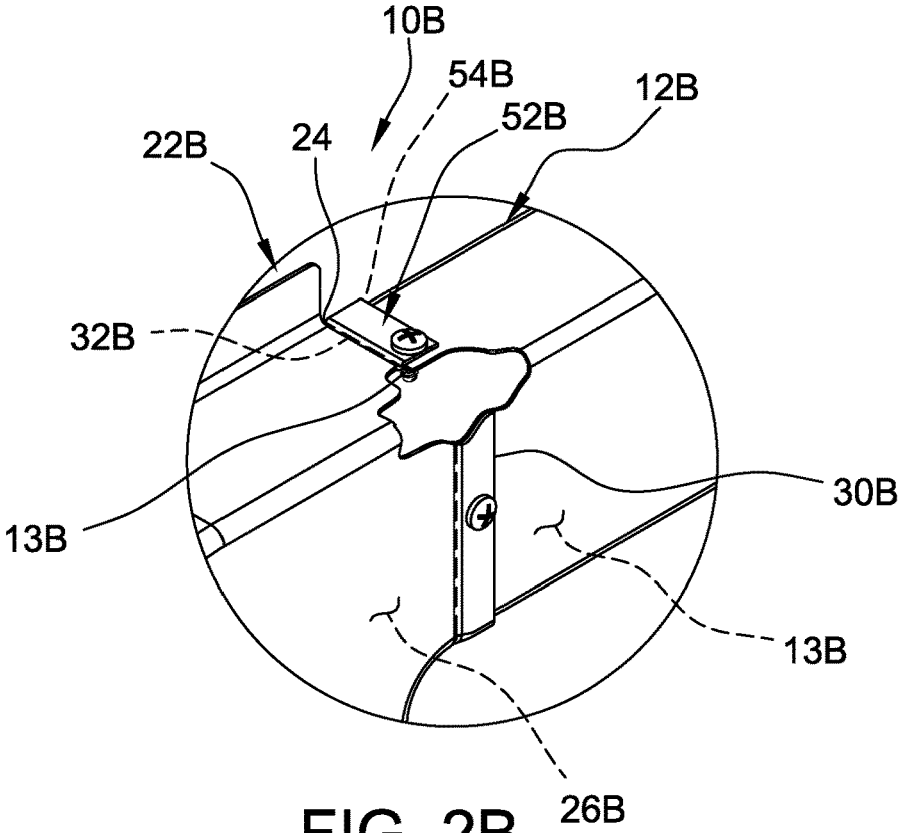
FIG. 2B is a partial perspective view of a furnace blower assembly according to the present invention with the outlet external to the duct and the protrusion positioned on the surface of the interior of the outlet.
Figure 5B:
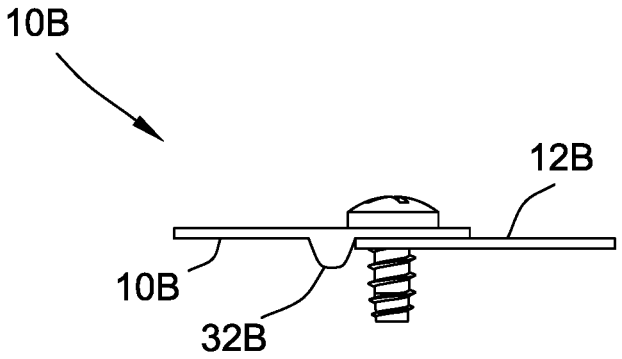
FIG. 5B is enlarged view of a portion of the furnace blower assembly of FIG. 2B, showing the protrusion in greater detail and positioned on the surface of the interior of the outlet.

Alternatively and referring to FIGS. 2B and 5B, for blower housing outlet 22B and duct 12B to be connected to each other and provide containment of the air flow 40, furnace blower assembly 10B may be provided such that a portion 52B of internal periphery 26B of the outlet 22B may, as shown in FIGS. 2B and 5B, be fitted within a portion 54B of the external periphery 13B of the duct 12B.

As shown in FIGS. 2-5, the blower housing outlet 22 further defines peripheral edge 30 of blower housing outlet 22. The blower housing outlet 22 further defines protrusion 32 extending outward from the external periphery 24 of the outlet 22 and spaced from the peripheral edge 30 of the outlet 22. The protrusion 32 is adapted to abut edge 13 of the duct 12.

Alternatively and referring to FIGS. 2B and 5B, furnace blower assembly 10B may be provided such that the blower housing outlet 22B further defines protrusion 32B extending outward from the internal periphery 26B of the outlet 22B and spaced from the peripheral edge 30B of the outlet 22B. The protrusion 32B is adapted to abut an edge 13B of the duct 12B.

As shown in FIGS. 2A and 5A the duct 22 may be secured to the outlet 22 of the housing 16 by an additional securing means in addition to the fit between the duct 22 and the outlet 22. For example and as shown in FIGS. 2A and 5A, fasteners 34 may be inserted into openings 35 formed in the outlet 22 and in the duct 12. The fasteners may be, as shown, screws, for example, sheet metal screws 34. Alternatively, the fasteners may be rivets, pins, or clips. Any alternative devices may be used to assist in securing the duct 12 to the outlet 22 of the housing 16.

The protrusion 32 may have any suitable shape and may be integral with the outlet 22 or may be a separate component. If integral, the protrusion 32 may be fabricated into the outlet in any suitable fashion, such as by stamping or forming with a press, brake or other equipment or tools. If integral, the protrusion may be in the form of an external bead formed from the housing 16.

The protrusion 32 may, for simplicity, have a uniform cross section and may extend along the periphery of the outlet 22 either partially or completely around the periphery of the outlet. The protrusion may extend generally along a plane or may be fabricated in a non-planar manner. A planar uniform protrusion may be simpler to produce and simpler to mate with the peripheral edge 30 of the outlet 22.

Figure 5C:
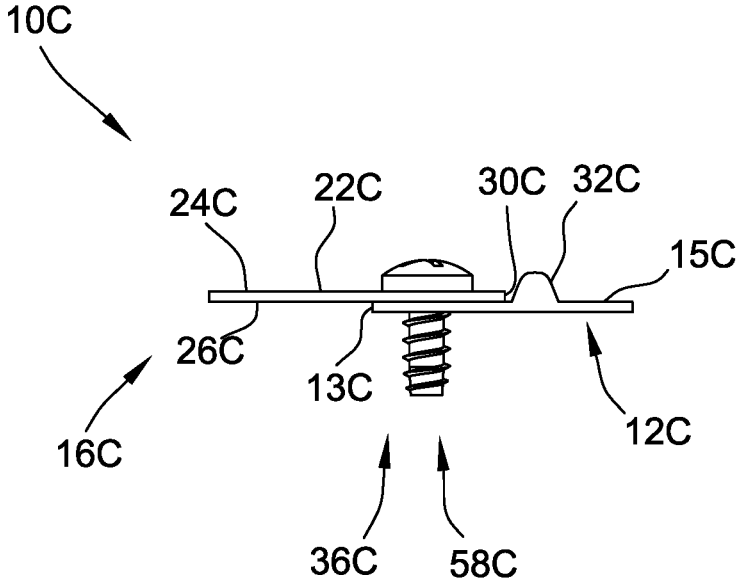
FIG. 5C is enlarged view of a portion of the furnace blower assembly of FIG. 2C, showing the protrusion in greater detail and positioned on the exterior of the duct.
Figure 5D:
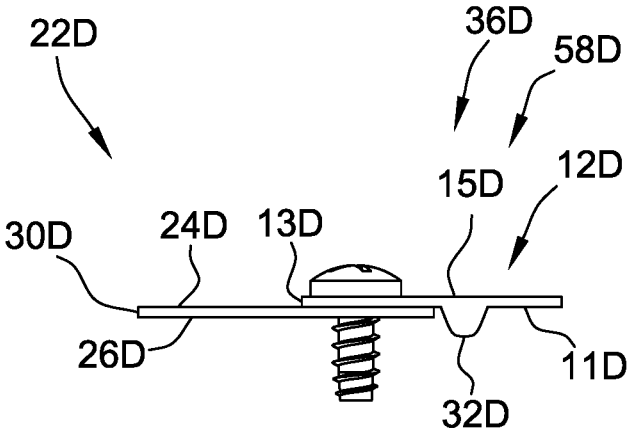
FIG. 5D is enlarged view of a portion of the furnace blower assembly of FIG. 2D, showing the protrusion in greater detail and positioned on the surface of the interior of the duct.
Figure 5E:
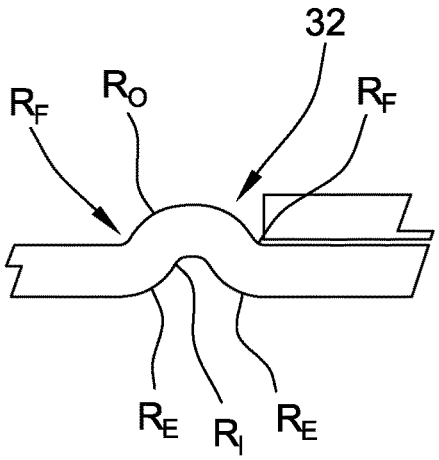
FIG. 5E is enlarged view of a portion of the furnace blower assembly according to the present invention, showing a protrusion with an arcuate shape.

Referring to FIGS. 5A, 5E, SF and 5G, the protrusion 32 may have any suitable cross sectional shape.

For example and as shown in FIG. 5E the protrusion 32 may have an arcuate shape and may be defined by edge radii $R_e$ and fillet radii $R_f$ as well as by internal radii $R_i$ and outer radii $R_o$. For example, and as shown in FIG. 5E, the protrusion 32 may have a generally inverted U-shaped cross section.

Figure 5F:
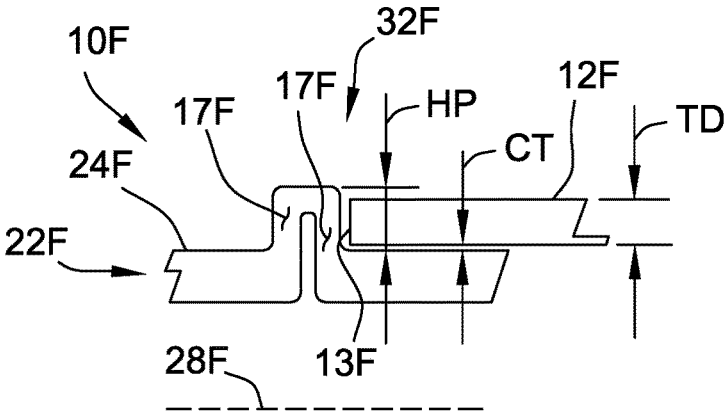
FIG. 5F is enlarged view of a portion of the furnace blower assembly according to the present invention, showing a protrusion with two rectangular portions.

Alternatively and as shown in FIG. 5F, the protrusion 32F of outlet 22F of assembly 10F may be provided wherein the cross section of the protrusion includes two generally rectangular portions 17F extending generally normal to the longitudinal axis 28F of the outlet 22F.

The protrusion 32F may extend outwardly from the periphery 24F of the outlet 22F sufficiently to provide a surface for the edge 13F of the duct 12F to engage. The protrusion 32F may have a height HP extending from the periphery 24F that is greater than the Thickness TD of the duct 12F. The height HP may also be greater than the thickness TD and any clearance and tolerance CT of the assembly 1OF and the duct 12F.

Figure 5G:
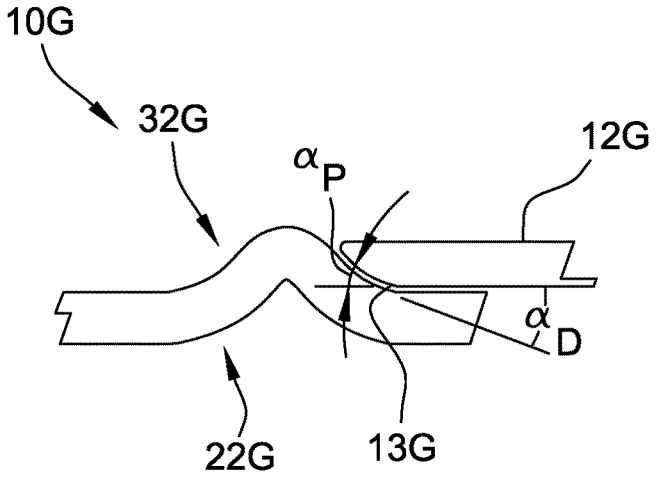
FIG. 5G is enlarged view of a portion of the furnace blower assembly according to the present invention, showing a protrusion with a gentle engagement angle.

Alternatively and as shown in FIG. 5G, protrusion 32G of outlet 22G of assembly 10G may be provided wherein the protrusion 32G forms an engagement angle $\alpha_p$ with the engagement angle $\alpha_d$ of the edge 13G of the duct 12G. This angled engagement may provide an improved seal, but may result in the position of the edge 13G to vary with respect to the assembly 10G, making automation of the assembly of the outlet 22G to the duct 12G more difficult.

As shown in FIG. 5, the furnace blower assembly 10 may be provided wherein the protrusion 32 of the outlet 22 of the housing 16 extends peripherally around the outlet 22 in direction of arrow 56 generally perpendicular to the longitudinal axis 28 of the outlet 22.

According to another aspect of the present invention, the furnace blower assembly may be provided wherein the protrusion 32 of the outlet 22 of the housing 16 is adapted to provide a substantially airtight seal between the duct 12 and the housing 16. It should be appreciated that the seal or interface between the duct 12 and the housing 16 may be acceptable with a substantial amount air being able to leak between the duct and the housing, provided that a substantial majority of the airflow 40 passes through the duct 12.

While the invention may be practiced with the protrusion placed on the outlet of the furnace blower assembly, it should be appreciated that the sealing between the blower assembly and the duct may be accomplished by providing the protrusion on the duct, rather than on the outlet of the blower assembly.

According to another embodiment of the invention and referring to FIGS. 2C, 2D, 5C and 5D, alternate furnace sub assemblies, 10C and 10D are provided with protrusions 32C and 32D, respectively, being positioned respectively on the exterior and the interior of the respective ducts 12C and 12D.

Figure 2C:
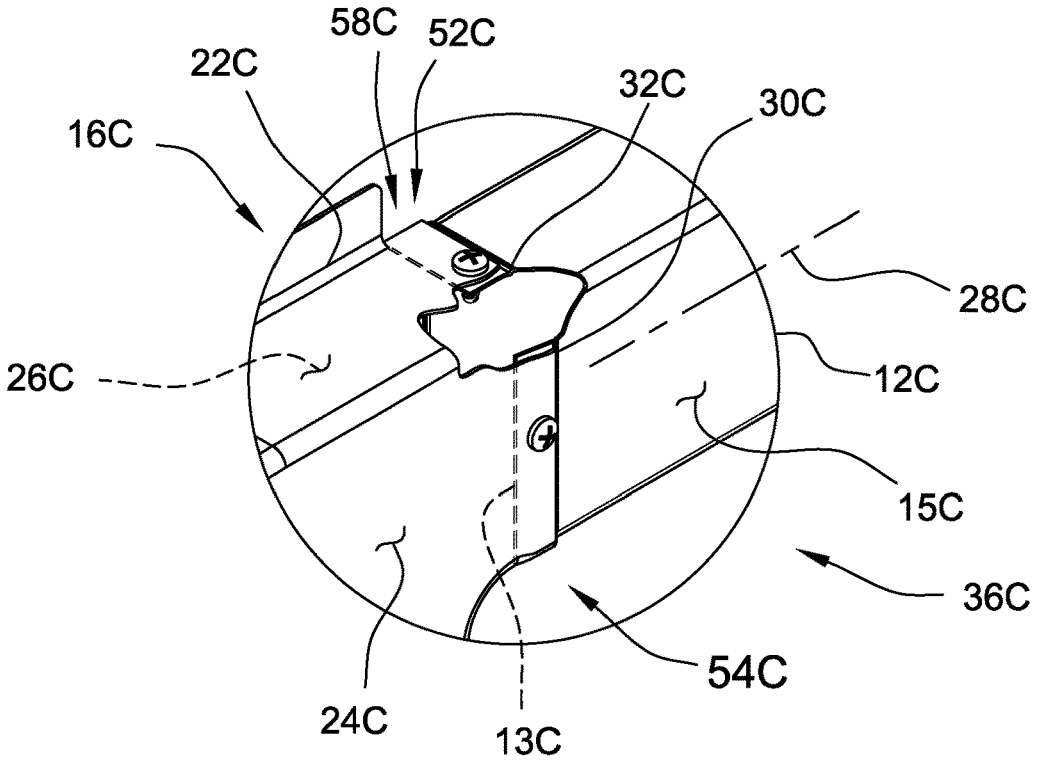
FIG. 2C is a partial perspective view of a furnace blower assembly according to the present invention with the outlet internal to the duct and the protrusion positioned on the exterior of the duct.

Referring now to FIGS. 2C and 5C, a furnace sub assembly 58C for use in a furnace 36C is provided. The furnace sub assembly 58C includes a duct 12C and a furnace blower assembly 10C. The duct 12C has an interior periphery 11C and an exterior periphery 15C of the duct 12C and defines a peripheral edge 13C of the duct 12C.

The furnace blower assembly 10C is adapted for use in the furnace 36C and is operably connected to housing 16C. The housing 16C defines an outlet 22C of the housing 16C. The outlet 22C has an external periphery 24C of the outlet 22C and an internal periphery 26C of the outlet 22C.

A portion 52C of the internal periphery 26C of the outlet 22C is adapted to be fitted to at least a portion 54C of the external periphery 15C of the duct 12C. The outlet 22C defines a longitudinal axis 28C of the outlet 22C. The outlet 22C defines a peripheral edge 30C of the outlet 22C. The duct 12C defines a protrusion 32C extending outwardly from the external periphery 13C of the duct 12C. The protrusion 32C is spaced from the peripheral edge 13C of the duct 12C. The protrusion 32C is adapted to abut the edge 30C of the outlet 22.

Figure 2D:
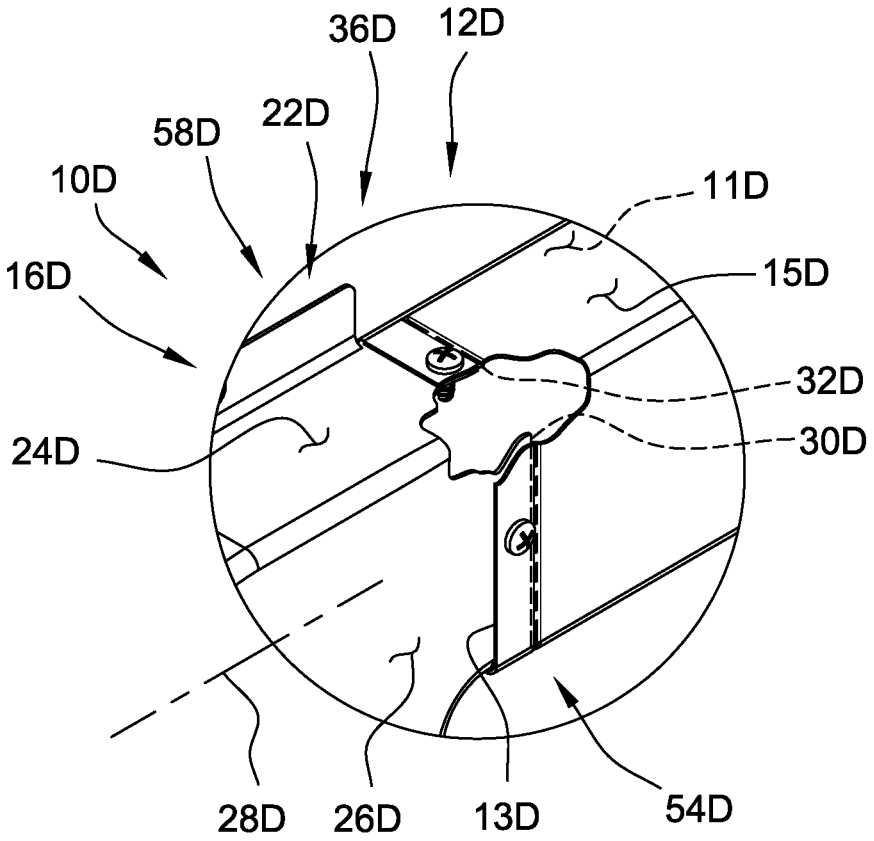
FIG. 2D is a partial perspective view of a furnace blower assembly according to the present invention with the outlet external to the duct and the protrusion positioned on the surface of the interior of the duct.
Figure 3:
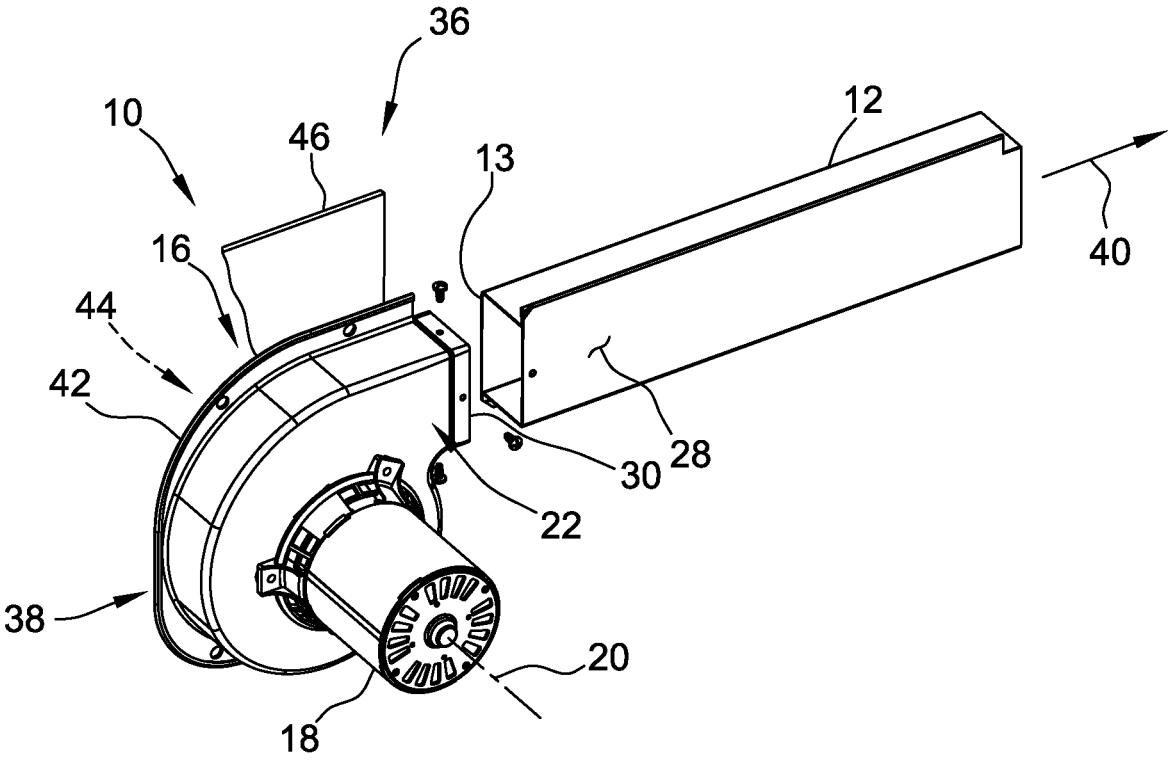
FIG. 3 is an exploded perspective view of the furnace blower assembly of FIG. 2.
Figure 4:
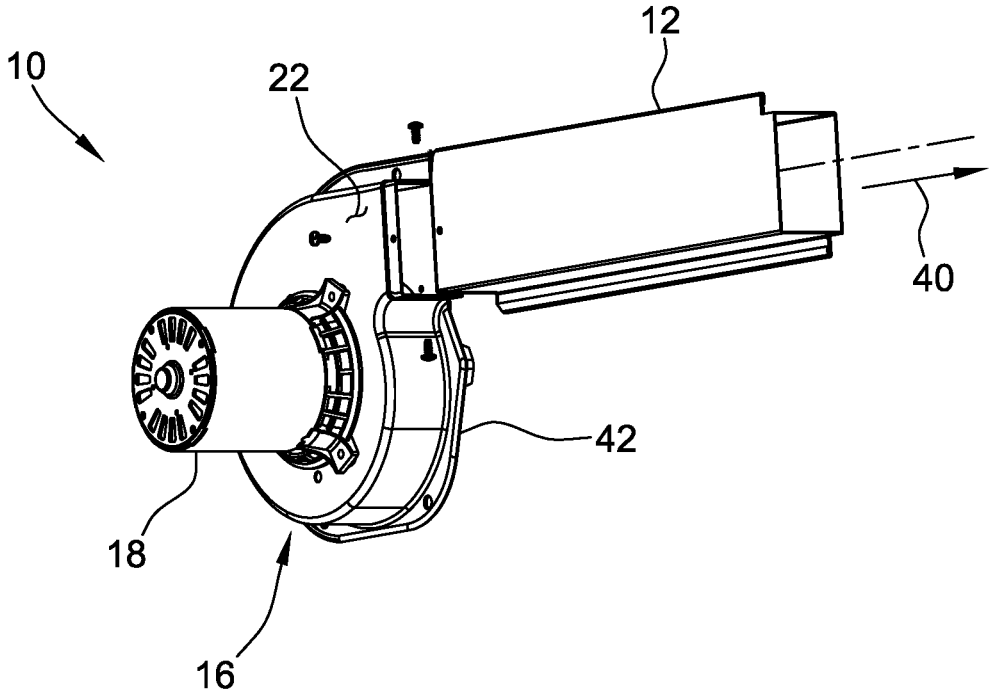
FIG. 4 is another exploded perspective view of the furnace blower assembly of FIG. 2.

Referring now to FIGS. 2D and 5D, a furnace sub assembly 58D for use in a furnace 36D is provided. The furnace sub assembly 58D includes a duct 12D and a furnace blower assembly 10D. The duct 12D has an interior periphery 11D and an exterior periphery 15D of the duct 12D and defines a peripheral edge 13D of the duct 12D.

The furnace blower assembly 10D is adapted for use in the furnace 36D and is operably connected to housing 16D. The housing 16D defines an outlet 22D of the housing 16D. The outlet 22D has an external periphery 24D of the outlet 22D and an internal periphery 26D of the outlet 22D A portion 52D of the external periphery 24D of the outlet 22D is adapted to be fitted to at least a portion 54D of the internal periphery 11D of the duct 12D. The outlet 22D defines a longitudinal axis 28D of the outlet 22D. The outlet 22D defines a peripheral edge 30D of the outlet 22D. The duct 12D defines a protrusion 32D extending outwardly from the internal periphery 11D of the duct 12D. The protrusion 32D is spaced from the peripheral edge 13D of the duct 12D. The protrusion 32D is adapted to abut the edge 30D of the outlet 22D.

Figure 6:
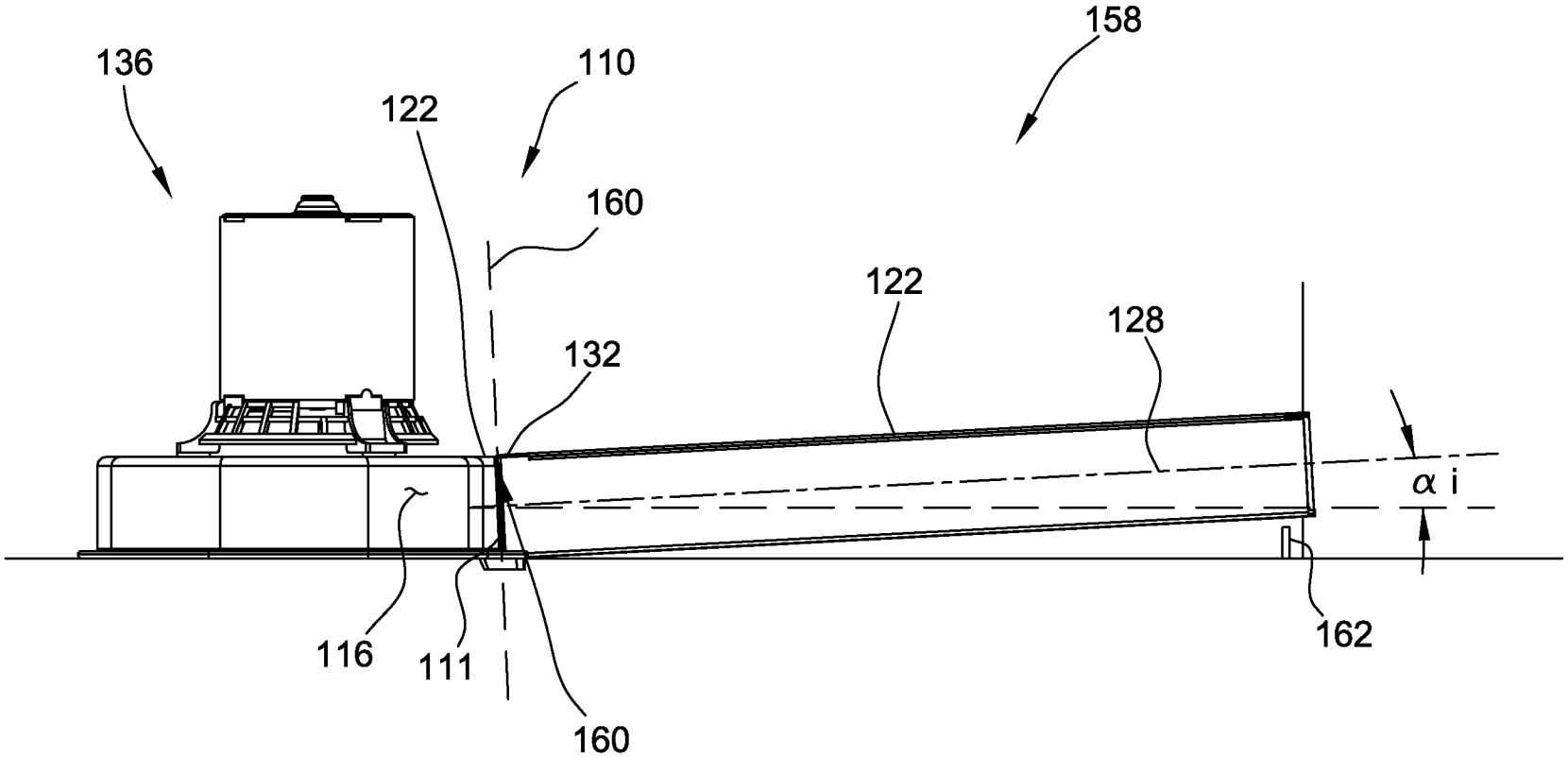
FIG. 6 is a plan view of a furnace sub assembly with the protrusion in a skewed position providing for an upwardly inclined duct.

Referring now to FIG. 6 another embodiment of the present invention is shown in furnace sub assembly 158. Furnace subassembly 158 includes a furnace blower assembly 110 similar to the blower assembly 10 of FIGS. 1-5, except blower assembly 110 includes housing 116 with a blower outlet 122 different from blower outlet 22 of FIGS. 1-5.

The blower outlet 122 includes a protrusion 132 similar to protrusion 32 of FIGS. 2-5 except that protrusion 132 is skewed to longitudinal axis 128 of the outlet 122. The protrusion 132 as shown is planar along plane 160 as shown in FIG. 6. It should be appreciated that the protrusion could alternately be non-planar, but if so would preferably have edge 111 of the duct 112 modified to mate with protrusion 132.

This skewing of the protrusion 132 provides the duct 122 with an installation angle $\alpha_i$ pointing upwardly to clear obstruction 162 in the furnace 136.

Figure 7:
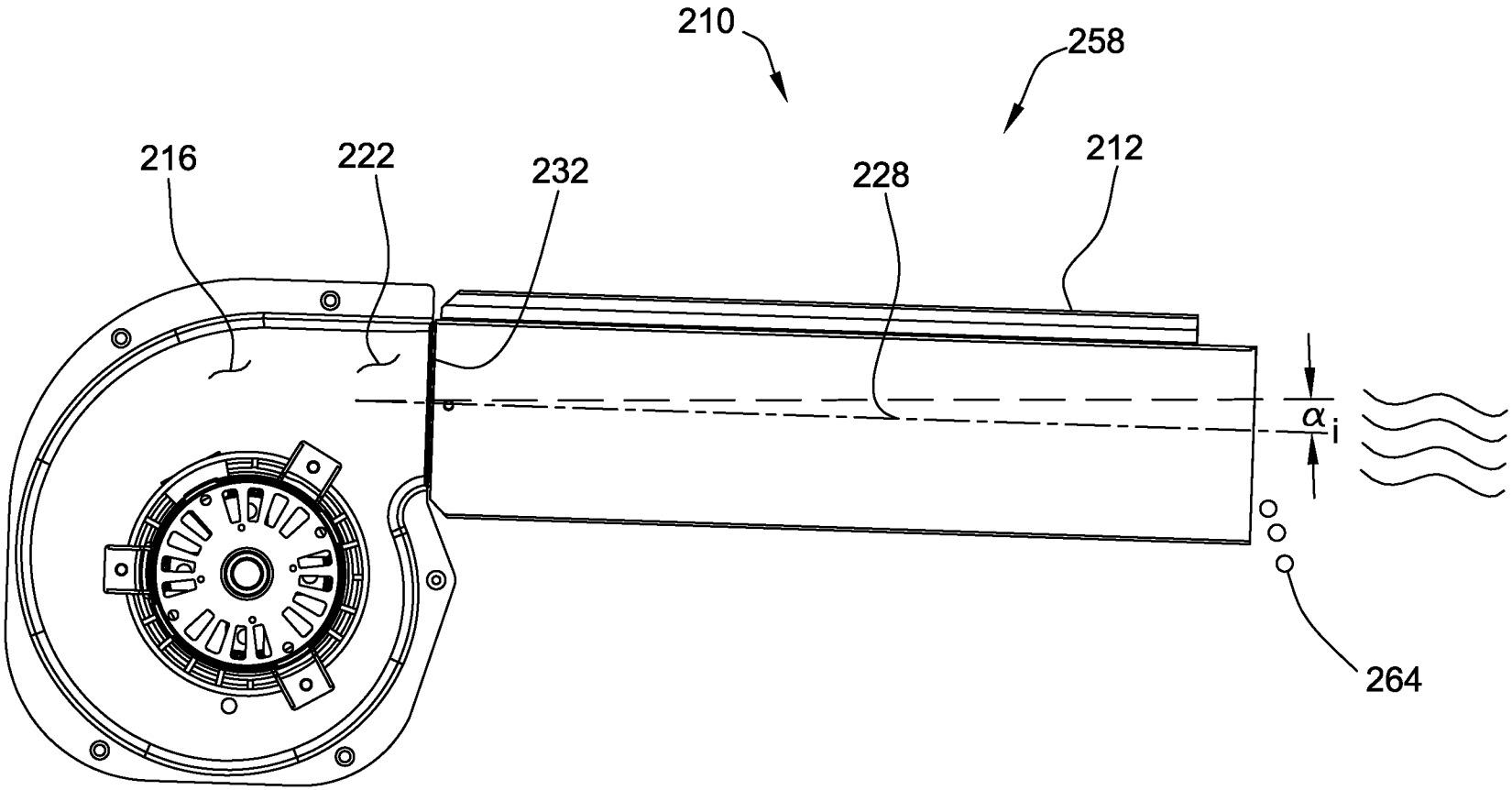
FIG. 7 is a plan view of a furnace sub assembly with the protrusion in another skewed position providing for a downwardly inclined duct.
Figure 8:
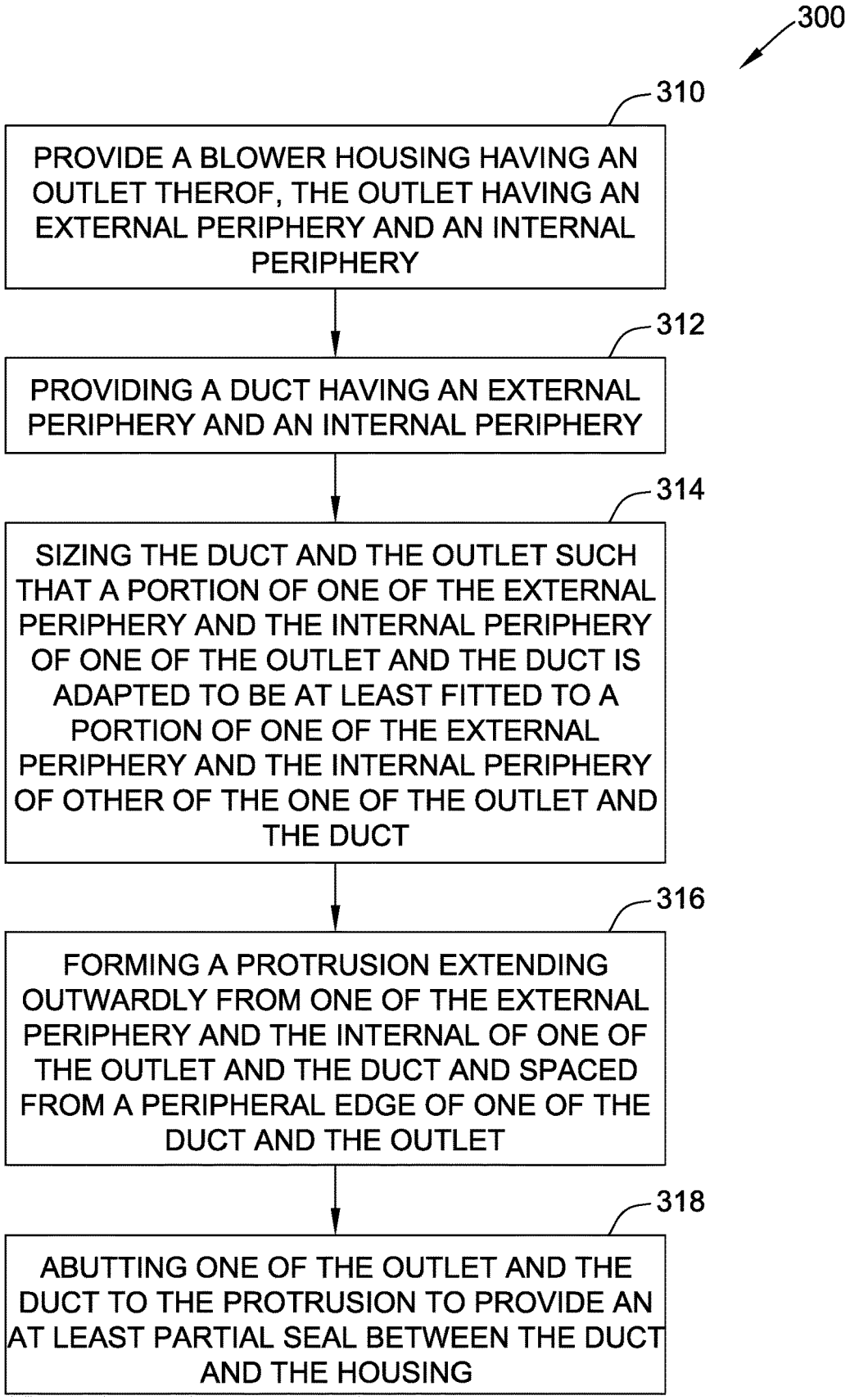
FIG. 8 is a flow chart of another embodiment of the present invention in the form of a method for providing a furnace blower.

Referring now to FIG. 7 another embodiment of the present invention is shown in furnace sub assembly 258. Furnace subassembly 258 includes a furnace blower assembly 210 similar to the blower assembly 10 of FIGS. 1-5, except blower assembly 210 includes housing 216 with a blower outlet 222 different from blower outlet 22 of FIGS. 1-5.

The blower outlet 222 includes a protrusion 232, similar to protrusion 132, in that protrusion 232 is skewed to longitudinal axis 228 of the outlet 222. However, protrusion 232 is skewed at an installation angle $\alpha_{ii}$ pointing downwardly to promote the exiting from the duct 212 of any condensate 264.

According to another embodiment of the invention, a method 300 for sealing a blower housing to a duct in a furnace is provided. The method 300 includes step 310 of providing a blower housing having an outlet thereof. The outlet has an external periphery thereof and an internal periphery. The method 300 further includes step 312 of providing a duct having an external periphery and an internal periphery. The method 300 further includes step 314 of sizing the duct and the outlet such that a portion of one of the external periphery and the internal periphery of one of the outlet and the duct is adapted to be at least fitted to a portion of one of the external periphery and the internal periphery of other of the one of the outlet and the duct. The method 300 further includes step 316 of forming a protrusion extending outwardly from one of the external periphery and the internal of one of the outlet and the duct and spaced from a peripheral edge of one of the duct and the outlet. The method 300 further includes step 318 of abutting one of the outlet and the duct to the protrusion to provide an at least partial seal between the duct and the housing.

When introducing elements/components/etc. of the methods and apparatus described and/or illustrated herein, the articles "a", "an", "the", and "the" are intended to mean that there are one or more of the element(s)/component(s)/etc. The terms "comprising", "including", and "having" are intended to be inclusive and mean that there may be additional element(s)/component(s)/etc. other than the listed element(s)/component(s)/etc.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

Described herein are exemplary methods, systems and apparatus utilizing lower cost materials in a permanent magnet machine that reduces or eliminates the efficiency loss caused by the lower cost material. Furthermore, the exemplary methods system and apparatus achieve increased efficiency while reducing or eliminating an increase of the length of the machine. The methods, system and apparatus described herein may be used in any suitable application. However, they are particularly suited for HVAC applications.

Exemplary embodiments of the fluid flow device and system are described above in detail. The electric machine and its components are not limited to the specific embodiments described herein, but rather, components of the systems may be utilized independently and separately from other components described herein. For example, the components may also be used in combination with other machine systems, methods, and apparatuses, and are not limited to practice with only the systems and apparatus as described herein. Rather, the exemplary embodiments can be implemented and utilized in connection with many other applications.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A furnace blower assembly for cooperation with a duct having an interior periphery and an exterior periphery thereof and defining a peripheral edge thereof, said furnace blower assembly comprising:

a blower housing;

a blower positioned at least partially within said housing, said blower being adapted to rotate relative to said housing about a blower axis;

a motor operatively coupled to said blower, said housing defining an outlet thereof, the outlet having an external periphery thereof and an internal periphery thereof, a portion of one of the external periphery and the internal periphery of the outlet adapted to be at least fitted to a portion of one of the external periphery and the internal periphery of the duct such that a portion of the housing overlaps with a portion of the duct, the outlet defining a longitudinal axis thereof, the outlet defining a peripheral edge thereof, the outlet defining a protrusion extending outwardly from one of the external periphery and the internal periphery of the outlet, said protrusion spaced from the peripheral edge of the outlet, said protrusion adapted to abut the peripheral edge of the duct, wherein an upstream portion of the one of the external periphery and the internal periphery of the outlet from which the protrusion extends is aligned with a downstream portion of the one of the external periphery and the internal periphery of the outlet from which the protrusion extends, and wherein the outlet is planar between the protrusion and the peripheral edge thereof, wherein the protrusion defines a circumferential groove about the outlet in the opposing one of the external periphery or internal periphery from which the protrusion extends;

wherein the protrusion comprises a mating surface that is obliquely oriented with respect to the downstream portion of the outlet, and wherein the peripheral edge of the duct is correspondingly obliquely oriented to form a seal when engaged with the protrusion mating surface, wherein an outermost surface of the protrusion is positioned outward of an outermost surface of the duct adjacent said protrusion, wherein the protrusion extends peripherally along a periphery of the outlet defining a plane, wherein the plane of the protrusion of the outlet of said housing is at an installation angle to the longitudinal axis of the outlet so that the duct, when abutting the protrustion, extends in a direction skewed to the longtiudinal axis of the outlet; and a fastener extending through the overlapping portions of the outlet and the duct and positioned between the protrusion and the peripheral edge of the outlet, wherein said fastener is configured for insertion into aligned openings in the duct and said outlet.

2. The furnace blower assembly as set forth in claim 1, wherein a portion of the internal periphery of the outlet is adapted to be fitted to a portion of the external periphery of the duct, and wherein said protrusion of the outlet of said housing extends from the internal periphery of the outlet.

3. The furnace blower assembly as set forth in claim 1, wherein a portion of the external periphery of the outlet is adapted to be fitted to a portion of the internal periphery of the duct, and wherein said protrusion of the outlet of said housing extends from the external periphery of the outlet.

4. The furnace blower assembly as set forth in claim 1, wherein said protrusion of the outlet of said housing comprises an external bead formed from said housing.

5. The furnace blower assembly as set forth in claim 1, wherein said protrusion of the outlet of said housing extends peripherally around substantially all of the outlet.

6. The furnace blower assembly as set forth in claim 1, wherein said protrusion of the outlet of said housing is adapted provide a substantially airtight seal between the duct and said housing.

7. The furnace blower assembly as set forth in claim 1, wherein said protrusion of the outlet of said housing defines a dimension normal to the external periphery of the outlet that is greater than the thickness of the wall of the duct.

8. The furnace blower assembly as set forth in claim 1, wherein said protrusion of the outlet of said housing has a generally uniform cross section.

9. The furnace blower assembly as set forth in claim 1, wherein said protrusion of the outlet of said housing has a generally inverted U-shaped cross section.

10. The furnace blower assembly as set forth in claim 1, wherein the cross section of said protrusion has an arcuate periphery.

11. The furnace blower assembly as set forth in claim 1, wherein the protrusion includes a constant thickness substantially similar to a thickness of the upstream portion and the downstream portion of the outlet on either side of the protrusion.

12. A furnace sub assembly for use in a furnace, comprising:

a duct adapted for use in the furnace, said duct having an interior periphery and an exterior periphery thereof and defining a peripheral edge thereof; and a furnace blower assembly adapted for use in the furnace and operably connected to said duct, said furnace blower assembly including:

a blower housing;

a blower positioned at least partially within said blower housing, said blower being adapted to rotate relative to said housing about a blower axis; and a motor operatively coupled to said blower, said housing defining an outlet thereof, the outlet having an external periphery thereof and an internal periphery thereof, a portion of one of the external periphery and the internal periphery of the outlet adapted to be at least fitted to a portion of one of the external periphery and the internal periphery of said duct such that a portion of the housing overlaps with a portion of the duct, the outlet defining a longitudinal axis thereof, the outlet defining a peripheral edge thereof, one of the outlet and said duct defining a protrusion extending outwardly from one of the external periphery and the internal periphery of the respective one of the outlet and said duct, said protrusion spaced from the peripheral edge of the respective one of the outlet and said duct, said protrusion adapted to abut the edge of the respective one of the outlet and said duct, wherein an upstream portion of the one of the external periphery and the internal periphery of the outlet from which the protrusion extends is aligned with a downstream portion of the one of the external periphery and the internal periphery of the outlet from which the protrusion extends, and wherein the outlet is planar between the protrusion and the peripheral edge thereof, wherein the protrusion defines a circumferential groove about the outlet in the opposing one of the external periphery or internal periphery from which the protrusion extends;

wherein the protrusion comprises a mating surface that is obliquely oriented with respect to the downstream portion of the outlet, and wherein the peripheral edge of the duct is correspondingly obliquely oriented to form a seal when engaged with the protrusion mating surface, wherein an outermost surface of the protrusion is positioned outward of an outermost surface of the duct adjacent said protrusion, wherein the protrusion extends peripherally along a periphery of the outlet defining a plane, wherein the plane of the protrusion of the outlet of said housing tion is at an installation angle to the longitudinal axis of the outlet so that the duct, when abutting the protrusion, extends in a direction skewed to the longitudinal axis of the outlet; and a fastener extending through the overlapping portions of the outlet and the duct and positioned between the protrusion and the peripheral edge of the outlet, wherein said fastener is configured for insertion into aligned openings in said duct and said outlet.

13. The furnace sub assembly as set forth in claim 12, wherein a portion of the external periphery of the outlet is adapted to be fitted to a portion of the internal periphery of said duct; wherein said protrusion extends outwardly from the external periphery of the outlet; and wherein said protrusion is adapted to abut the edge of said duct.

14. The furnace sub assembly as set forth in claim 12, wherein a portion of the internal periphery of the outlet is adapted to be fitted to a portion of the external periphery of said duct; wherein said protrusion extends from the internal periphery of the outlet;

and wherein said protrusion is adapted to abut the edge of said duct.

15. The furnace sub assembly as set forth in claim 12, wherein a portion of the internal periphery of said duct is adapted to be fitted to a portion of the external periphery of the outlet; wherein said protrusion extends outwardly from the internal periphery of said duct; and wherein said protrusion is adapted to abut the edge of the outlet.

16. The furnace sub assembly as set forth in claim 12, wherein a portion of the external periphery of said duct is adapted to be fitted to a portion of the internal periphery of the outlet; wherein said protrusion extends outwardly from the external periphery of said duct; and wherein said protrusion is adapted to abut the edge of the outlet.

17. The furnace blower assembly as set forth in claim 14, wherein said protrusion comprises an external bead formed in one of said housing and said duct.

18. A method for sealing a blower housing to a duct in a furnace comprising the steps of:

providing a blower housing having an outlet thereof, the outlet having an external periphery thereof and an internal periphery thereof;

providing a duct having an external periphery thereof and an internal periphery thereof;

sizing the duct and the outlet such that a portion of one of the external periphery and the internal periphery of one of the outlet and the duct is adapted to be at least fitted to a portion of one of the external periphery and the internal periphery of other of the one of the outlet and the duct;

forming a protrusion extending outwardly from one of the external periphery and the internal of one of the outlet and the duct and spaced from a peripheral edge of one of the duct and the outlet, wherein an upstream portion of the one of the external periphery and the internal periphery of the outlet from which the protrusion extends is aligned with a downstream portion of the one of the external periphery and the internal periphery of the outlet from which the protrusion extends, and wherein the outlet is planar between the protrusion and the peripheral edge thereof, wherein the protrusion defines a circumferential groove about the outlet in the opposing one of the external periphery or internal periphery from which the protrusion extends, wherein the protrusion extends peripherally along a periphery of the outlet defining a plane, wherein the plane of the protrusion of the outlet of said housing is at an installation angle to the longitudinal axis of the outlet so that when the outlet or duct abut the protrusion the duct extends in a direction skewed to the longitudinal axis of the outlet; and abutting one of the outlet and the duct to the protrusion to provide an at least partial seal between the duct and the housing such that a portion of the housing overlaps with a portion of the duct, wherein the protrusion includes a mating surface that is obliquely oriented with respect to the downstream portion of the outlet, and wherein the peripheral edge of the duct is correspondingly obliquely oriented to form a seal when engaged with the protrusion mating surface, wherein an outermost surface of the protrusion is positioned outward of an outermost surface of the duct adjacent said protrusion; and extending a fastener positioned proximate the protrusion through the overlapping portions of the outlet and the duct such that the fastener is positioned between the protrusion and the peripheral edge of the outlet, wherein the fastener is configured for insertion into aligned openings in the duct and the outlet.

* * * * *